US005458073A

United States Patent [19]

Harada et al.

[11] Patent Number: 5,458,073

[45] Date of Patent: Oct. 17, 1995

[54] CYLINDER-BED TYPE SEWING MACHINE

[75] Inventors: Shuichi Harada; Makoto Hosokawa, both of Shijonawate, Japan

[73] Assignee: Morimoto Mfg. Co., Ltd., Shijonawate, Japan

[21] Appl. No.: 283,501

[22] Filed: Aug. 1, 1994

[30] Foreign Application Priority Data

Aug. 11, 1993 [JP] Japan ..... 5-199424

[51] Int. Cl.[6] ..... D05B 27/00

[52] U.S. Cl. ..... 112/63; 112/261; 112/324

[58] Field of Search ..... 112/63, 163, 164, 112/165, 166, 167, 303, 308, 323, 324, 262.2, 62, 261

[56] References Cited

U.S. PATENT DOCUMENTS 2,489,489 11/1949 Heggie ..... 112/62
4,289,083 9/1981 Ciucani ..... 112/62 X
4,827,856 5/1989 Rohr ..... 112/63
4,834,010 5/1989 Choi et al. ..... 112/63 X
5,271,347 12/1993 Fontcuberta ..... 112/63 X

*Primary Examiner*—Peter Nerbun
*Attorney, Agent, or Firm*—Jones, Tullar & Cooper

[57] ABSTRACT

In the cylinder-bed type sewing machine of the invention, a cylinder unit is provided. A feed base support, a feed base, and a feed dog which are disposed in the cylinder unit are reciprocally rotated in vertical and lengthwise directions in accordance with movements of a feed lifting rock shaft and a feed lengthwise shaft. The vertical and lengthwise reciprocal movements of the feed base are synthesized so that the feed dog is moved along an arcuate feeding locus. According to the cylinder-bed type sewing machine of the present invention, the peripheral length of the cylinder unit for holding a tubular sewing product which is fitted onto the cylinder unit, and the distance between a throat plate and the left end of the cylinder unit can be reduced as much as possible, and the feed dog can be moved along the arcuate locus. Therefore, a predetermined feeding operation on the sewing product can be conducted surely and smoothly.

4 Claims, 8 Drawing Sheets

CYLINDER-BED TYPE SEWING MACHINE

BACKGROUND OF THE INVENTION

1. Field of the Invention

The present invention relates to a cylinder-bed type sewing machine which is preferably used for stitching tubular sewing products such as cuffs of trousers, or sleeve edges of a T-shirt, and more particularly to an improved driving mechanism for a feed dog which allows a work support unit to be formed into a cylindrical shape so that a tubular sewing product is sewn while being fitted onto the work support cylinder unit, and the tubular sewing product to be fed rearward along the outer periphery of the work support cylinder unit.

2. Description of the Prior Art

Conventionally, such a sewing machine is disclosed in, for example, Laid Open Japanese Patent Application Nos. 62-240,093 and 4-20,372. The disclosed sewing machines are provided with a work support unit which is formed into a substantially rectangular box-like shape. A throat plate is disposed on the upper face of the substantially rectangular box-like work support unit, and a feed dog is disposed so that a sewing product on the throat plate is fed rearward in synchronization with the vertical motion of a sewing needle. The feed dog is configured so as to circulate along a locus which is substantially rectangular.

In such a prior art sewing machine, a tubular sewing product is usually fitted onto the work support unit to be held thereon and then subjected to the sewing operation. In such a prior art example in which the work support unit is formed into a substantially rectangular box-like shape, the work support unit has a large peripheral length. When a sewing product having a small peripheral length, such as a sleeve edge of children's wear is to be sewn, therefore, it is impossible to fit the sewing product onto the work support unit to be held thereon. Consequently, the kinds of sewing products which can be sewn by the sewing machine are restricted, and hence the sewing machine has a drawback of reduced versatility.

Although not shown, another prior art sewing machine has been proposed in which a work support unit is formed into a cylindrical shape so that the distance between the left end of the cylindrical work support unit and a throat plate is reduced as much as possible. The sewing machine cannot be used for a tubular sewing product which must be sewn while being fitted deeply onto the work support unit, thereby giving rise to a problem of applicability. Also in a cylinder-bed type sewing machine in which a cylinder of the work support has a small peripheral length so as to cope with a tubular sewing product of a small peripheral length, when a feed dog is configured so as to circulate along a locus which is substantially rectangular in the same manner as the feed dog of the above-described prior art example, the feed dog conducts the feeding operation on the sewing product while making point contact with the sewing product, and therefore the sewing product cannot be fed properly and smoothly.

SUMMARY OF THE INVENTION

It is an object of the present invention to provide a cylinder-bed type sewing machine in which the peripheral length of a cylinder unit and the distance between the left end of the cylinder unit and a throat plate are reduced as much as possible so that the sewing machine has higher versatility and applicability for tubular sewing products.

It is another object of the present invention to provide a cylinder-bed type sewing machine in which the feeding operation on a sewing product can be conducted surely and smoothly.

The cylinder-bed type sewing machine of the present invention which achieves the objects noted comprises: a cylinder unit; a throat plate disposed at a position which is on an upper face of the cylinder unit and confronts a needle; a feed dog, disposed in a hole which is formed in the throat plate, for rearward feeding a sewing product along an outer periphery of the cylinder unit; and a needle guard which can be reciprocally and lengthwise moved so as to make contact with the needle under a state in which the needle passes through the throat plate, and an arcuate feeding active portion formed in the feed dog and having a curvature which is the same as that of the cylinder unit; a feed base to which the feed dog is fixedly connected; a U-like feed base support, rotated about a shaft which is concentrical with the center of the cylinder unit, for slidably and respectively holding the feed base support, and for rotating the feed dog about the shaft; a feed lifting rock shaft which is driven by a crank shaft rotating in one direction, and which is disposed in the cylinder unit; a slide block, formed on a front end portion of the feed lifting rock shaft and fitted into a notched portion formed in the feed base, for vertically reciprocating the feed base so that the feeding active portion is vertically moved between a position where the feeding active portion of the feed dog is projected from the hole of the throat plate toward the outer peripheral portion of the cylinder unit, and another position where the feeding active portion is retracted from the hole into the cylinder unit; a feed lengthwise shaft which is disposed in the cylinder unit, which is moved by the crank shaft, and which is parallel to the feed lifting rock shaft; and a connecting link, connecting a front end portion of the feed lengthwise shaft with the feed base, for lengthwise reciprocating the feed base so that the feeding active portion of the feed dog is reciprocally moved while forming a feeding locus in which the feeding active portion is moved arcuately and rearward, and also a nonfeeding locus in which the feeding active portion is moved forward.

According to the thus configured cylinder-bed type sewing machine of the present invention, the feed base support, the feed base which is vertically slidably held by the feed base support, and the feed dog which is fixedly connected to the feed base are rotated about the shaft which is concentrical with the center of the cylinder unit. The vertical and lengthwise reciprocal movements of the feed base due to the reciprocal rotations of the feed lifting rock shaft and the feed lengthwise shaft are synthesized, so that the distance between the arcuate feeding active portion of the feed dog and the outer peripheral face of the cylinder unit is always maintained at a fixed value irrespective of the position of the feeding active portion in the feeding locus. Therefore, the feeding active portion of the feed dog conducts the feeding operation on a tubular sewing product which is fitted onto the cylinder unit and held thereon, under a line contact state. Consequently, the sewing product can be fed properly and smoothly in a rearward direction. This allows the peripheral length of the cylinder unit, and the distance between the throat plate and the left end of the cylinder unit to be reduced as much as possible, whereby the versatility and applicability for tubular sewing products can be enhanced.

In the cylinder-bed type sewing machine of the present invention, it is preferable that the needle guard is independently formed in the cylinder unit and can independently be moved through a needle guard bracket which is reciprocally rotated by the crank shaft.

According to the thus configured cylinder-bed type sewing machine, it is not required to adjust the position of the needle guard each time when the feeding amount of the feed dog is adjusted, and therefore the operation of adjusting the feeding amount can be conducted very easily and rapidly.

In the cylinder-bed type sewing machine of the present invention, it is preferable that the longitudinal positions of the feed base and the feed base support are restricted by a pair of front and rear thrust plates.

Furthermore, the cylinder-bed type sewing machine of the present invention may be configured so that the feed dog is divided into front and rear feed dogs, independent feed bases to which the front and rear feed dogs are respectively fixedly connected are slidably and respectively held by independent U-like feed base supports which are rotated about a shaft which is concentrical with the center of the cylinder unit, slide blocks respectively fitted into notched portions formed in the feed bases are attached to a front end portion of one feed lifting rock shaft, and an eccentric mechanism for differential feed adjustment is interposed between the feed lengthwise shaft and one of the connecting links through which the feed bases are respectively connected to the one feed lengthwise shaft.

According to this configuration, the feeding operation on a sewing product can be conducted regularly and smoothly, and the feeding amounts of the front and rear feed dogs can be adjusted relatively so that differential feeding is realized.

These and other features, objects and advantages of the present invention will be more fully apparent from the following description of embodiments thereof.

DETAILED DESCRIPTION OR THE PREFERRED EMBODIMENT

Figure 1:
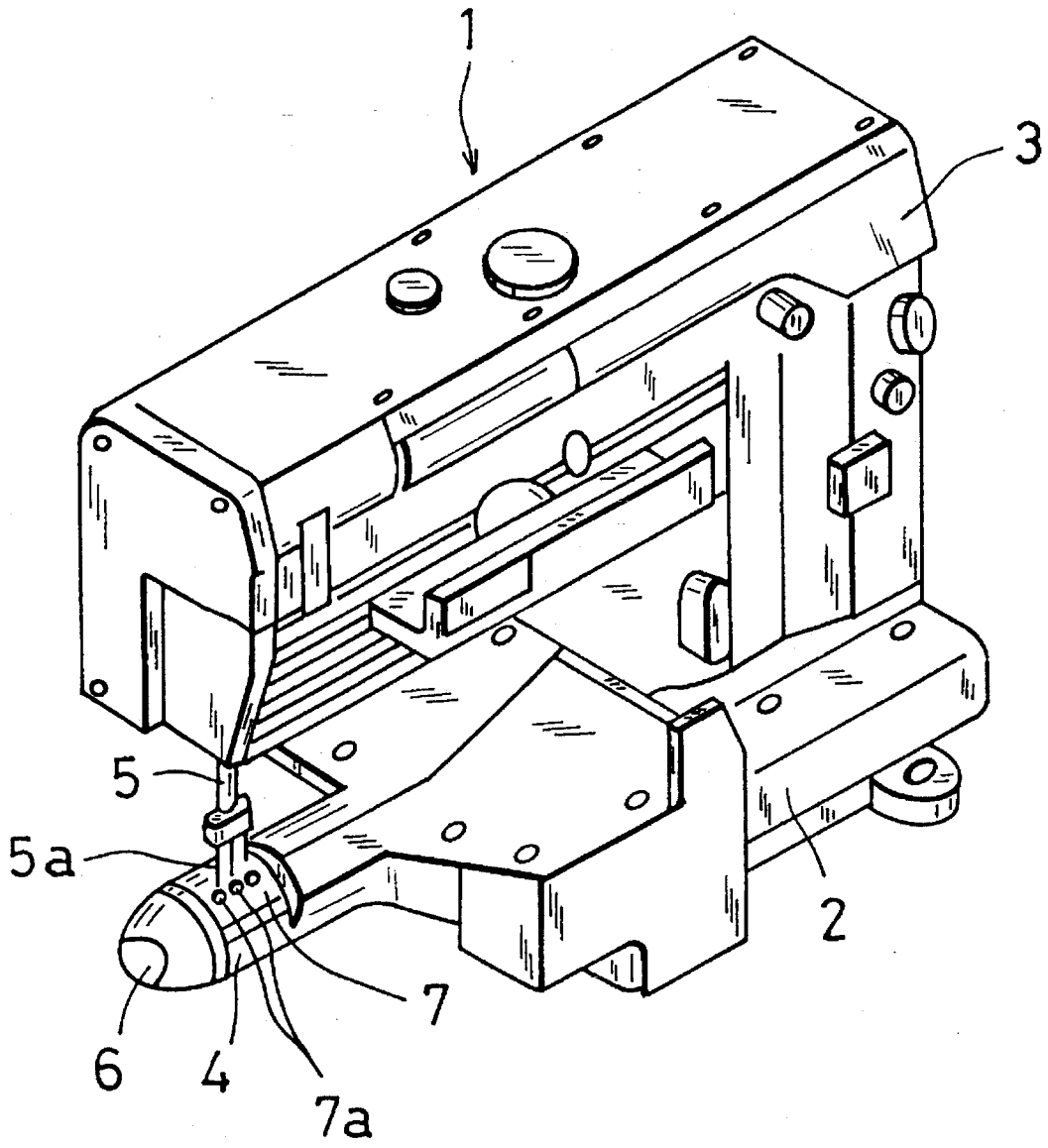
FIG. 1 is an external perspective view showing the whole configuration of a cylinder-bed type top-stitch sewing machine embodiment of the present invention.
Figure 2:
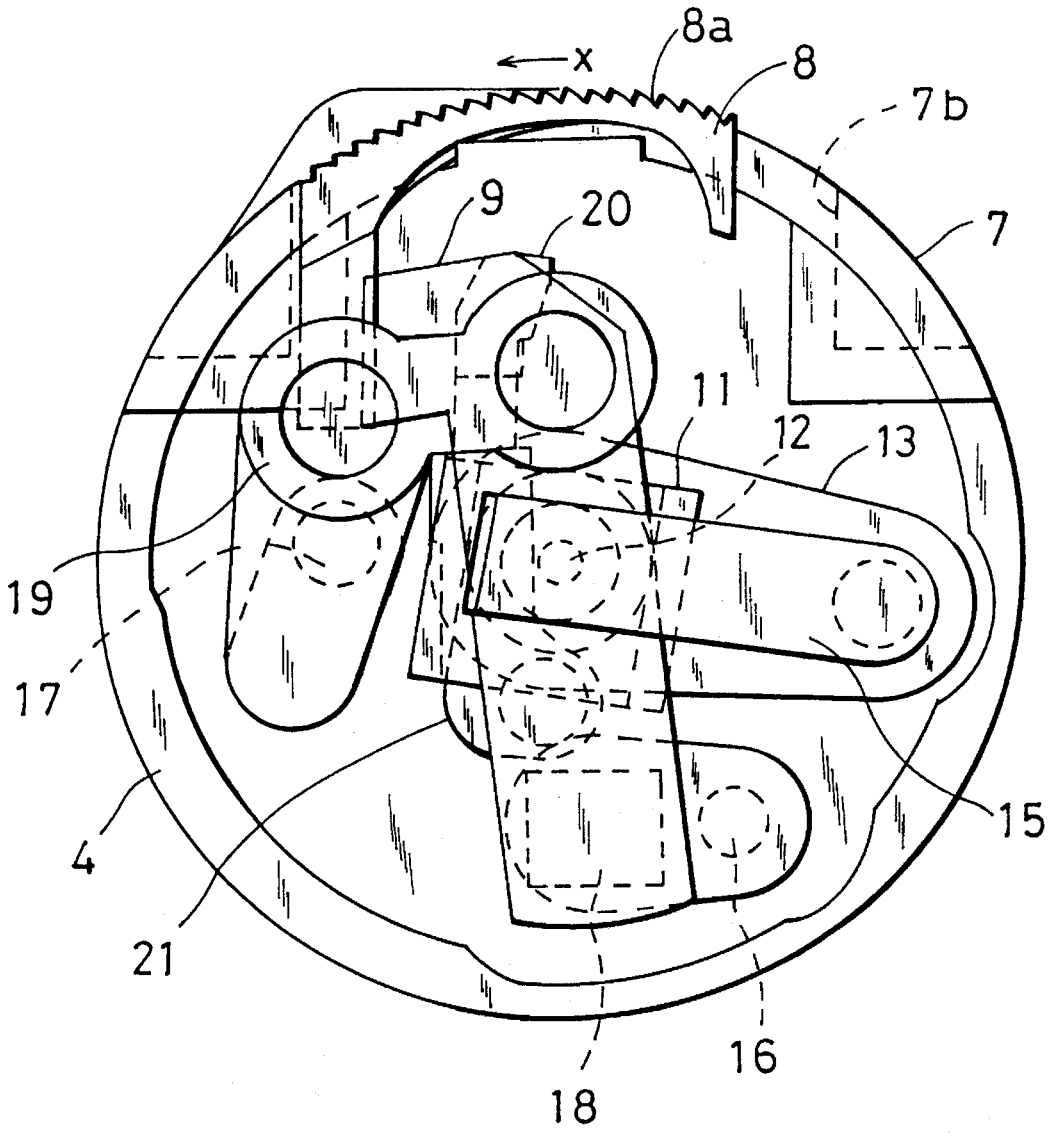
FIG. 2 is an enlarged longitudinal front section view of the main portion of FIG. 1.

As shown in FIGS. 1 and 2, the machine body 1 is configured by integrating into one body a bed 2, an arm 3 which extends upward from the right end portion of the bed 2 and then leftward, and a cylinder unit 4 which extends leftward from the left end portion of the bed 2. A needle bar 5 having, for example, three sewing needles 5*a* is disposed below the left end portion of the arm 3. The needle bar 5 is reciprocally and vertically moved by a driving mechanism which is not shown.

As shown in FIG. 2, the cylinder unit 4 has a cylindrical shape. A bullet-shaped cover 6 is attached to the left end portion of the cylinder unit 4. A throat plate 7 is disposed at a position which is on the upper face of the cylinder unit 4 and in the vicinity of the cover 6. The throat plate 7 confronts the sewing needles 5*a*. A looper (not shown) is located in the cylinder unit 4 and below the throat plate 7. Needle eye 7*a* are formed in the throat plate 7, through which the sewing needles 5*a* respectively pass, and a movement hole 7*b* for a feed dog 8 which will be described later. The feed dog 8 is disposed in the movement hole 7*b*. The feed dog 8 feeds a tubular sewing product which is fitted onto the cylinder unit 4 from the left outside portion and held thereon, along the outer periphery of the cylinder unit 4 and in the rearward direction indicated by an arrow x in FIG. 2. In the configuration described above, while a tubular sewing product is rearwardly fed on the throat plate 7 by the feed dog 8, a sewing operation is conducted to form a seam by the cooperation of the sewing needles 5*a* and the looper.

Figure 3:
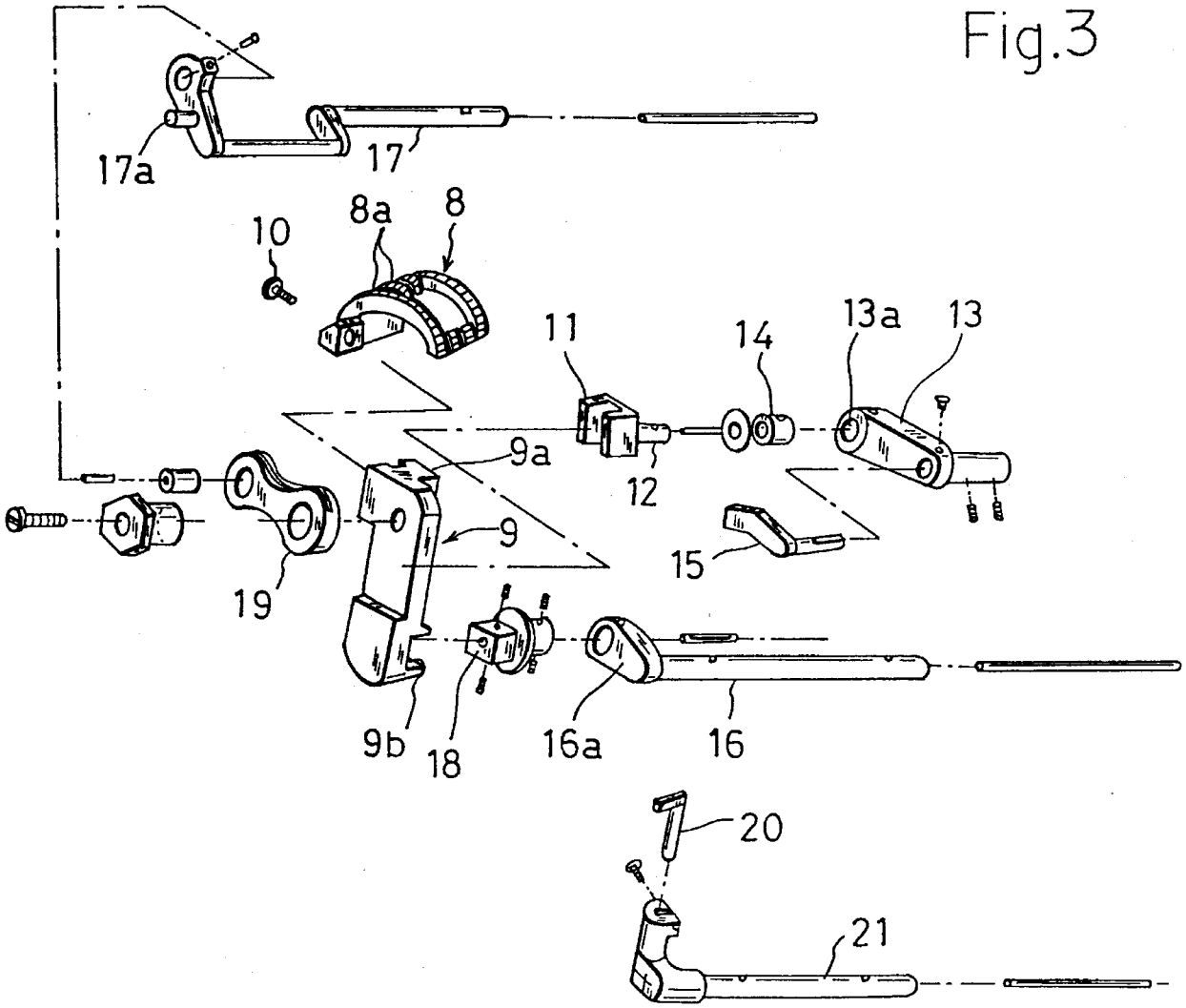
FIG. 3 is an exploded perspective view showing a driving mechanism for a feed dog and that for a needle guard in the embodiment of the present invention.

As shown in FIGS. 2 and 3, the feed dog 8 comprises a saw-tooth like feeding active portion 8*a* having an arcuate shape which has the same curvature as that of the cylinder unit 4.

Hereinafter, a driving mechanism for the arcuate feed dog 8 will be described in detail.

One end of the feed dog 8 viewed in the circumferential direction is fixedly connected by a screw 10 to an upper side face of a feed base 9 disposed in the cylinder unit 4. A ridge 9*a* which extends vertically is integrally formed on the right face of the upper portion of the feed base 9. The ridge 9*a* is sandwiched in the lengthwise direction by a U-like feed base support 11. Therefore, the feed base 9 is held so as to be vertically slidable with respect to the feed base support 11. The feed base support 11 has a shaft 12 which is concentrical with the center of the cylinder unit 4. The shaft 12 is inserted through a collar bushing 14 into a hole 13*a* which is formed in one end portion of a rear thrust plate 13. Consequently, the feed base support 11, the feed base 9, and the feed dog 8 can be rotated about the shaft 12. The reference numeral 15 designates a front thrust plate which cooperates with the rear thrust plate 13 so as to sandwich the front and rear faces of the feed base support 11 and the feed base 9, whereby the positions of the feed base support 11 and the feed base 9 are restricted in the longitudinal direction.

In the cylinder unit 4, a feed lifting rock shaft 16, and a feed lengthwise shaft 17 are disposed in parallel to each other. A slide block 18 is attached through an arm 16*a* to the front end portion (left end portion) of the feed lifting rock shaft 16. The slide block 18 is fitted into a notched portion 9*b* formed in the lower portion of the feed base 9. According to this configuration, the feed base 9 is reciprocally and vertically moved in accordance with the reciprocal rotation of the feed lifting rock shaft 16. On the other hand, the front end portion (left end portion) of the feed lengthwise shaft 17 is connected through a connecting link 19 to the vicinity of the upper end portion of the feed base 9 so that the feed base 9 is reciprocally and lengthwise moved in accordance with the reciprocal rotation of the feed lengthwise shaft 17.

In the thus configured driving mechanism for the arcuate feed dog, when the vertical and lengthwise reciprocal movements of the feed base 9 due to the reciprocal rotations of the feed lifting rock shaft 16 and the feed lengthwise shaft 17 are synthesized with providing predetermined timing, the feeding active portion 8*a* of the feed dog 8 is moved in a circulative manner while forming a sewing product feeding locus in which the feeding active portion 8*a* is moved arcuately and rearward while projecting from the movement hole 7*b* of the throat plate 7 toward the outer peripheral portion of the cylinder unit 4, and also a nonfeeding locus in which the feeding active portion 8*a* is moved forward while being retracted from the movement hole 7*b* into the cylinder unit 4.

Figure 4:
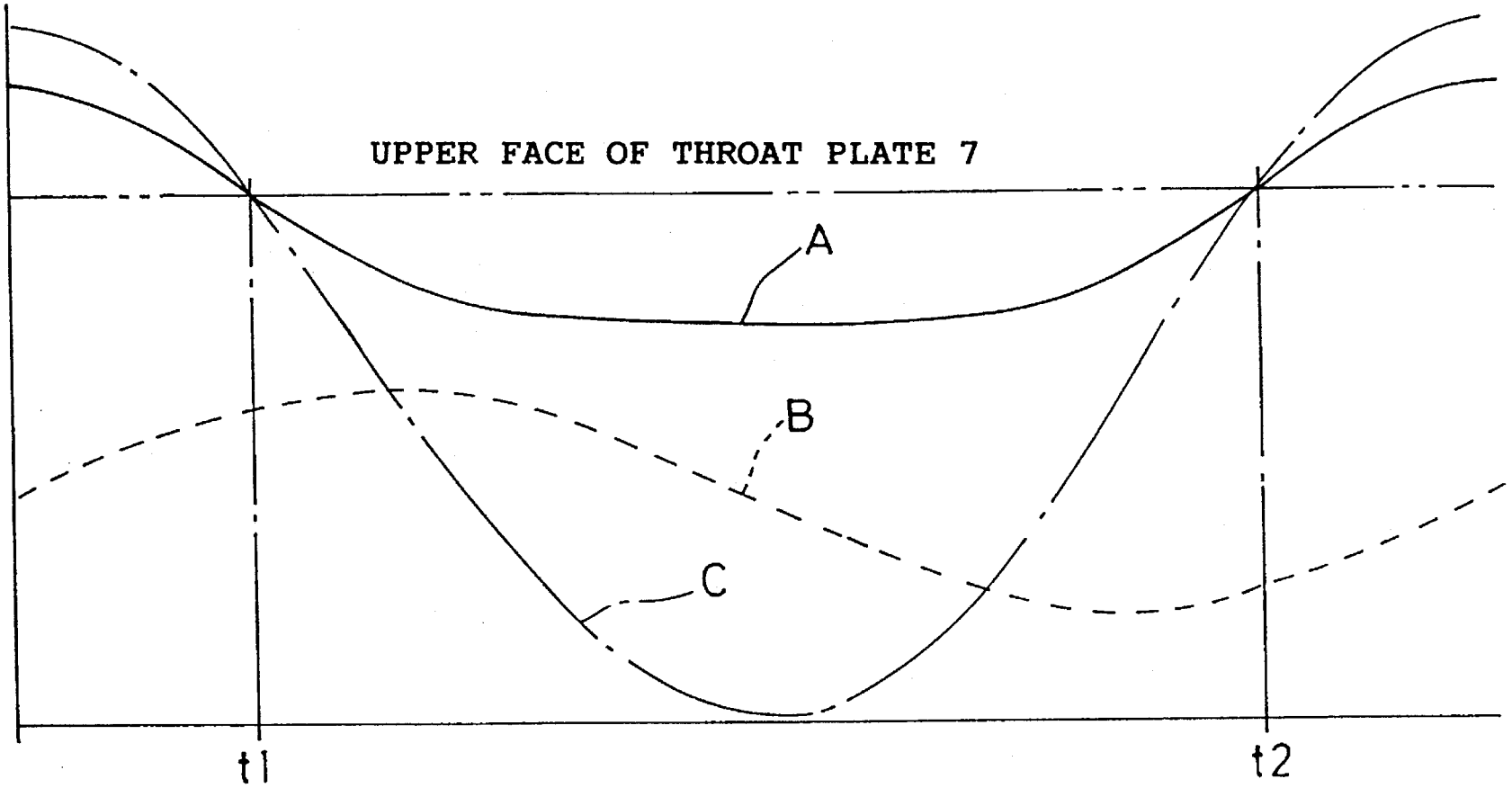
FIG. 4 is a diagram illustrating a locus of the feed dog.

A projection shaft 17*a* is disposed at the left end portion of the feed lengthwise shaft 17. The projection shaft 17*a* is supported by the cover 6 so that the feed lengthwise shaft 17 is prevented from vibrating. The circulative locus of the feed dog 8 is set so that, as shown by a solid line A in FIG. 4, the feed dog 8 is retracted from the outer face of the throat plate 7 into the cylinder unit 4 at time t1 when the sewing needles 5*a* fall into the needle eyes 7*a* of the throat plate 7, and projects onto the outer face of the throat plate 7 at time t2 when the sewing needles 5*a* are pulled upward out of the needle eyes 7*a*. When such a timing is set, a sewing product can be fed at the highest efficiency along the outer peripheral face of the cylinder unit 4. In the present invention, however, the timing operation of the sewing needles 5*a* and the feed dog 8 is not restricted to the one described above. In FIG. 4, a broken line B shows the feeding amount of the feed dog 8 in the lengthwise direction which is obtained when the above-mentioned timing is provided, and a one-dot chain line C shows the lifting amount of the sewing needles 5*a*.

In FIGS. 2 and 3, the reference numeral 20 designates a needle guard which, when the sewing needles 5*a* pass through the needle eyes 7*a* of the throat plate 7 to enter the cylinder unit 4, is contacted with the sewing needles 5*a* so as to prevent deformation from ocurring such as bending of the sewing needles 5*a*. The needle guard 20 is configured independently from the above-mentioned driving mechanism for the feed dog so as to be moved independently and lengthwise through a needle guard bracket 21 disposed in the cylinder unit 4.

Figure 5:
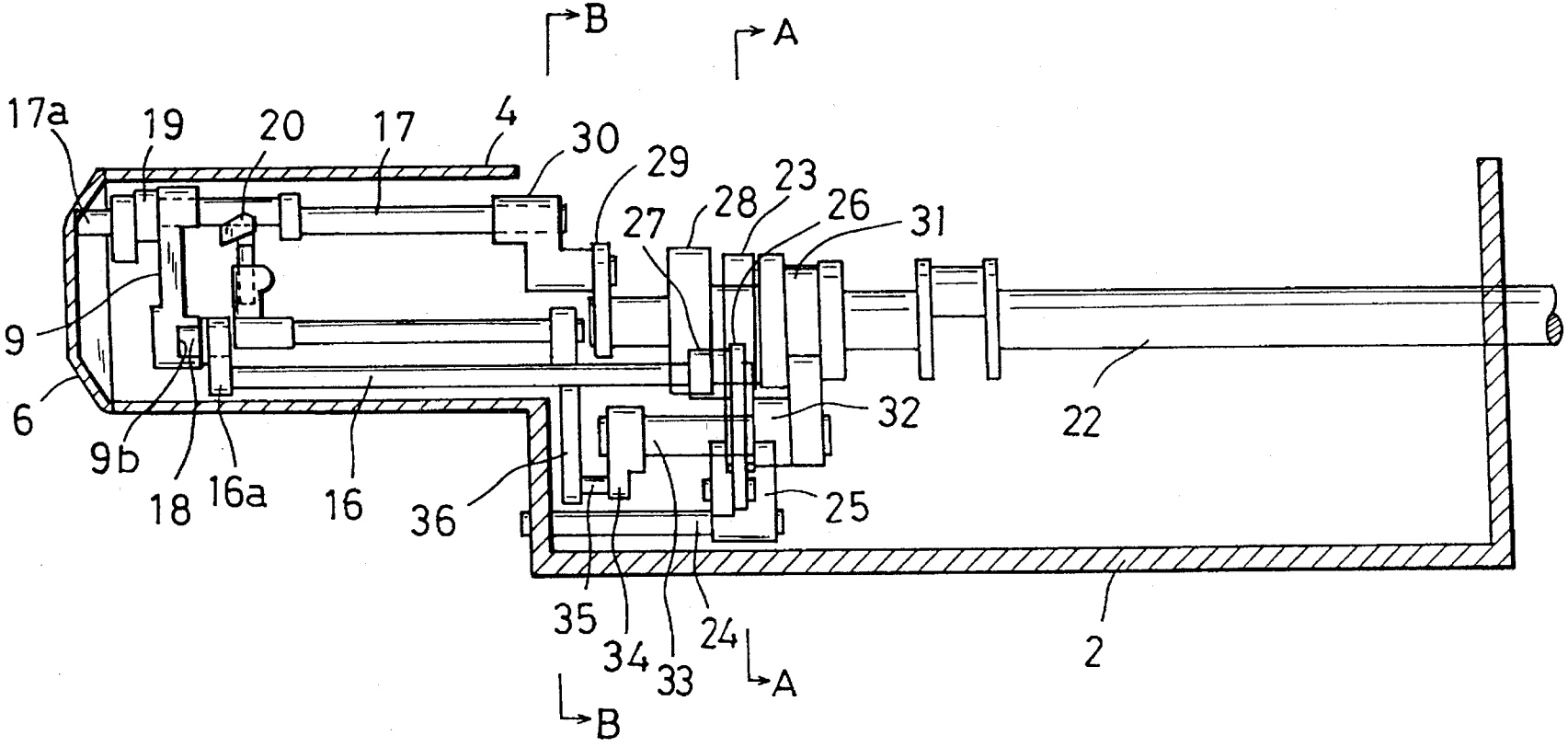
FIG. 5 is a longitudinal side section view showing a gang motion mechanism between a crank shaft, and a feed lifting rock shaft, a feed lengthwise shaft and a needle guard bracket in the embodiment of the present invention.
Figure 6:
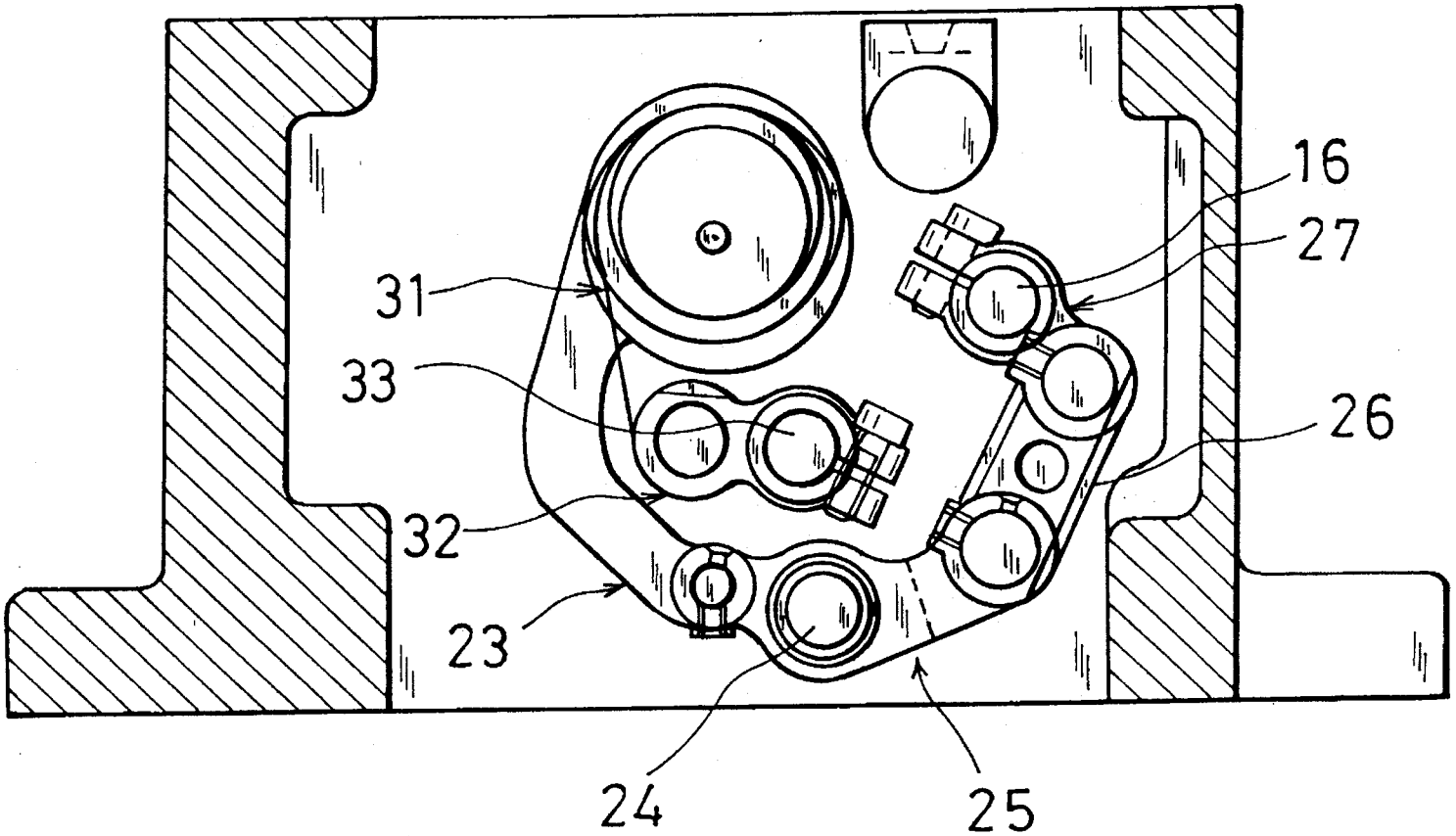
FIG. 6 is a section view taken along a line A—A of FIG. 5.
Figure 7:
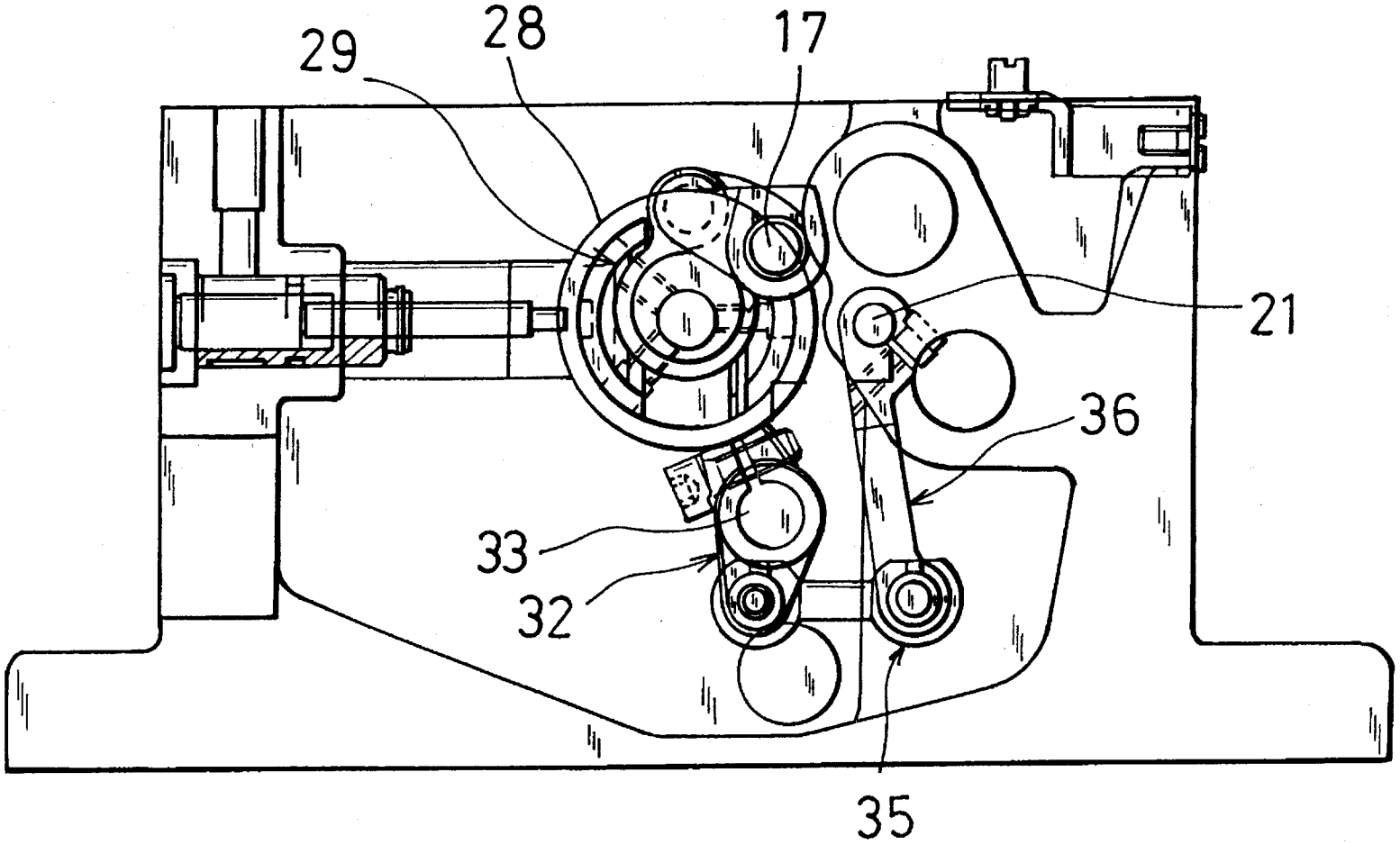
FIG. 7 is a section view taken along a line B—B of FIG. 5.

The feed lifting rock shaft 16, the feed lengthwise shaft 17, and the needle guard bracket 21 which have been described above are driven by a crank shaft 22 disposed in the bed 2. The configuration of the gang motion mechanism will be described with reference to FIGS. 5 to 7.

The crank shaft 22 is rotated in one direction by, for example, a motor (not shown) disposed outside the machine body 1. A feed lifting rod 23 is connected to the midpoint of the crank shaft 22 through a feed lifting eccentric (not shown). A feed lifting rock intermediate lever 25 which swings about a lifting rock fulcrum shaft 24 is connected to the feed lifting rod 23. The feed lifting rock intermediate lever 25 is connected to a feed lifting rock link 26 which is connected to a feed lifting rock lever 27. The right end portion of the feed lifting rock shaft 16 is fixedly connected to the feed lifting rock lever 27, so that the feed lifting rock shaft 16 is reciprocally rotated in accordance with the rotation in one direction of the crank shaft 22.

On the other hand, a feed lengthwise eccentric set 28 is attached to the left end portion of the crank shaft 22, whereby the amount of the lengthwise motion of the feed dog 8 can be adjusted. A feed lengthwise lever 30 is connected to the feed lengthwise eccentric set 28 through a feed lengthwise rod 29. The right end portion of the feed lengthwise shaft 17 is fixedly connected to the feed lengthwise lever 30, so that the feed lengthwise shaft 17 is reciprocally rotated in accordance with the rotation in one direction of the crank shaft 22.

A needle guard rod 31 is connected to the midpoint of the crank shaft 22 through a needle guard eccentric (not shown). A needle guard driving lever 36 is connected to the needle guard rod 31 through a needle guard lever 32, a needle guard intermediate shaft 33, a needle guard lever 34, and a link 35. The right end portion of the needle guard bracket 21 is fixedly connected to the needle guard driving lever 36 so that the needle guard bracket 21 is reciprocally rotated in accordance with the rotation in one direction of the crank shaft 22, and that the needle guard 20 is reciprocally and lengthwise moved in synchronization with the sewing needles 5*a*.

Next, the sewing operation of the thus configured cylinder-bed type sewing machine will be described briefly.

When the crank shaft 22 is rotated in one direction by the motor which is not shown, the feed lifting rock shaft 16 is reciprocally rotated by the gang motion mechanism which consists of the feed lifting eccentric (not shown), the feed lifting rod 23, the feed lifting rock intermediate lever 25, the feed lifting rock link 26, and the feed lifting rock lever 27. The reciprocal rotation of the feed lifting rock shaft 16 is transmitted through the slide block 18 to the feed base 9 so that the feed base 9 is reciprocally and vertically moved. Further, the feed lengthwise shaft 17 is reciprocally rotated by the gang motion mechanism which consists of the feed lengthwise eccentric set 28, the feed lengthwise rod 29, and the feed lengthwise lever 30. The reciprocal rotation of the feed lengthwise shaft 17 is transmitted through the connecting link 19 to the feed base 9 so that the feed base 9 is reciprocally and lengthwise moved. When the vertical and lengthwise reciprocal movements of the feed base 9 are synthesized, the feeding active portion 8*a* of the feed dog 8 is moved in a circulative manner while forming the sewing product feeding locus in which the feeding active portion 8*a* of the feed dog 8 is moved arcuately rearward while projecting from the movement hole 7*b* of the throat plate 7 toward the outer peripheral portion of the cylinder unit 4, and also the nonfeeding locus in which the feeding active portion 8*a* is moved forward while being retracted from the movement hole 7*b* into the cylinder unit 4. Therefore, a tubular sewing product on which a seam has been formed can be fed smoothly and rearwardly along the outer peripheral face of the cylinder unit 4.

When such a sewing operation is to be conducted, there occurs a case where the amount of the lengthwise motion of the feed dog 8 is adjusted by means of the feed lengthwise eccentric set 28 so as to comply with properties of a tubular sewing product. In this case, when the needle guard 20 is integrated with the feed base 9, the position of the needle guard must be changed each time when the feed dog 8 is adjusted. If the needle guard 20. Therefore configured independently from the driving mechanism for the feed dog 8 so as to be moved independently by the driving mechanism for the needle guard in the same manner as the embodiment, it is entirely unnecessary to change the position of the needle guard 20 even when the feeding amount of the feed dog 8 is adjusted.

Figure 8:
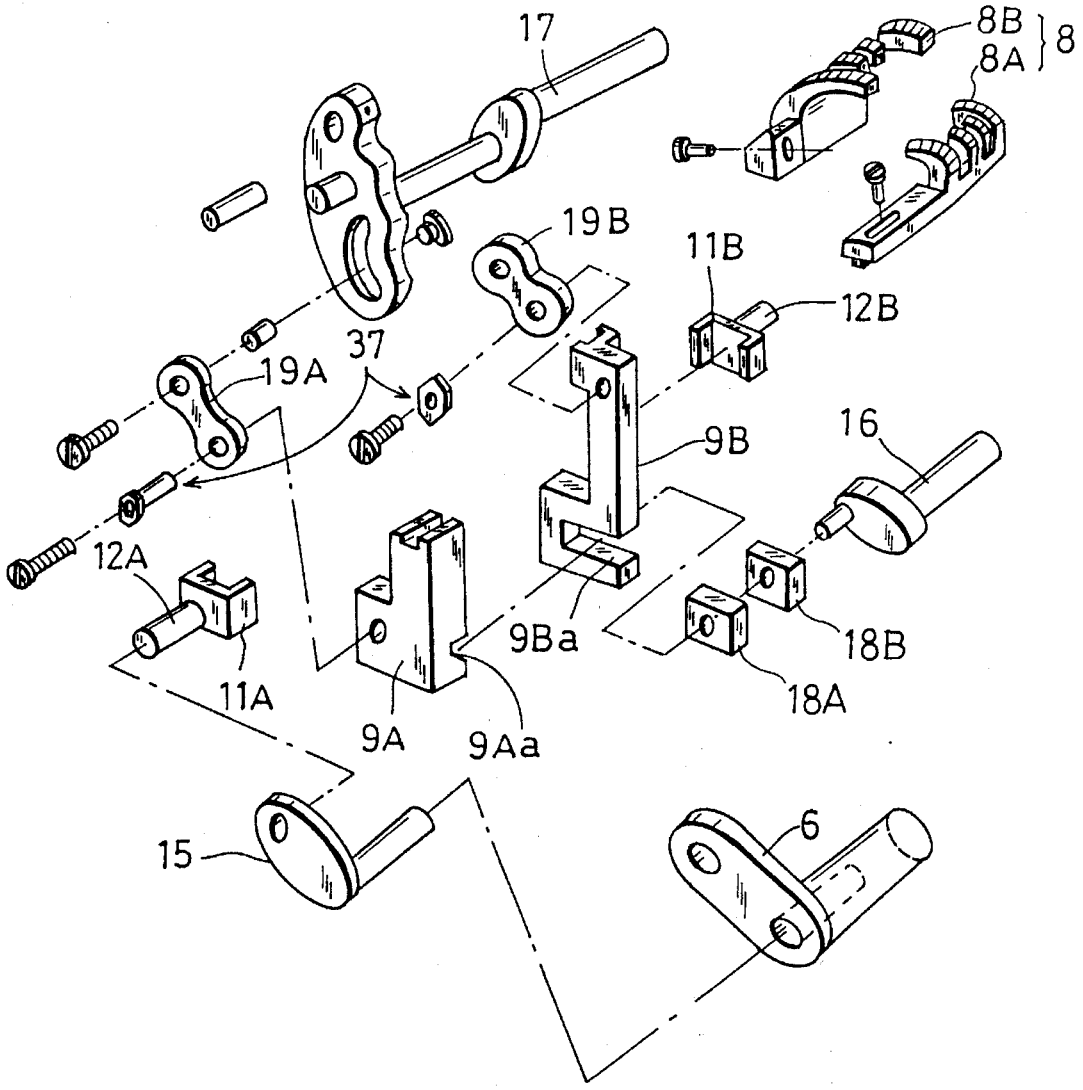
FIG. 8 is an exploded perspective view showing the main portion of a cylinder-bed type sewing machine according to another embodiment of the present invention.

FIG. 8 is an exploded perspective view showing the main portion of a cylinder-bed type sewing machine for another embodiment of the present invention.

In this embodiment, the feed dog 8 is divided into front and rear feed dogs 8A and 8B which are respectively fixed to a pair of front and rear feed bases 9A and 9B. The pair of front and rear feed bases 9A and 9B are slidably and respectively held by front and rear U-like feed base supports 11A and 11B which are rotated about shafts 12A and 12B that are concentric with the center of the cylinder unit 4. Slide blocks 18A and 18B are fitted into notched portions 9Aa and 9Ba formed in the pair of front and rear feed bases 9A and 9B, respectively. The slide blocks 18A and 18B are attached to the front end portion of one feed lifting rock shaft 16. An eccentric mechanism 37 for differential feed adjustment is interposed between the feed lengthwise shaft 17 and one of the paired connecting links 19A and 19B (in the embodiment, the front connecting link 19A) through which the pair of front and rear feed bases 9A and 9B are connected to the one feed lengthwise shaft 17. It is configured so that the feeding amounts of the front and rear feed dogs 8A and 8B can be differentiated by arbitrarily adjusting the eccentric mechanism 37 for differential feed adjustment. Alternatively, the feeding amount of the rear feed dog 8B may be adjusted.

What is claimed is:

1. A cylinder-bed type sewing machine comprising:

a cylinder unit having an outer periphery;

a throat plate disposed at a position which is on an upper face of said outer periphery of said cylinder unit and confronts a needle, said throat plate having a hole formed therein;

a feed dog, disposed in the hole formed in said throat plate, for rearward feeding of a sewing product along the outer periphery of said cylinder unit;

a needle guard reciprocally and lengthwise moved so as to make contact with the needle under a state in which the needle passes through said throat plate;

an arcuate feeding active portion formed in said feed dog and having a curvature which is the same as that of said cylinder unit;

a feed base to which said feed dog is fixedly connected, said feed base defining a notched portion;

a U-like feed base support, rotated about a shaft which is concentric with the center of said cylinder unit, for slidably and respectively holding said feed base support, and for rotating said feed dog about said shaft;

a crank shaft disposed in said cylinder unit;

a feed lifting rock shaft which is driven by said crank shaft rotating in one direction;

a slide block, formed on a front end portion of said feed lifting rock shaft and fitted into said notched portion formed in said feed base, for vertically reciprocating said feed base so that said arcuate feeding active portion is vertically moved between a position where said arcuate feeding active portion of said feed dog projects from said hole of said throat plate toward the outer peripheral portion of said cylinder unit, and another position where said arcuate feeding active portion is retracted from said hole into said cylinder unit;

a feed lengthwise shaft which is disposed in said cylinder unit, which is moved by said crank shaft, and which is parallel to said feed lifting rock shaft; and a connecting link, connecting a front end portion of said feed lengthwise shaft with said feed base, for lengthwise reciprocating said feed base so that said arcuate feeding active portion of said feed dog is reciprocally moved while forming a feeding locus in which said arcuate feeding active portion is moved arcuately and rearward, and also a nonfeeding locus in which said arcuate feeding active portion is moved forward.

2. A cylinder-bed type sewing machine according to claim 1, wherein said needle guard is independently formed in said cylinder unit and can independently be moved through a needle guard bracket which is reciprocally rotated by said crank shaft.

3. A cylinder-bed type sewing machine according to claim 1, wherein longitudinal positions of said feed base and said feed base support are restricted by a pair of front and rear thrust plates.

4. A cylinder-bed type sewing machine according to claim 1, wherein said feed dog is divided into front and rear feed dogs, independent feed bases to which said front and rear feed dogs are respectively fixedly connected are slidably and respectively held by independent U-like feed base supports which are rotated about a shaft which is concentric with the center of said cylinder unit, slide blocks respectively fitted into notched portions formed in said feed bases are attached to a front end portion of one feed lifting rock shaft, and an eccentric mechanism for differential feed adjustment is interposed between said feed length-wise shaft and one of connecting links through which feed bases are respectively connected to said one feed lengthwise shaft.

* * * * *